US006321800B1

(12) United States Patent
Ogawa et al.

(10) Patent No.: US 6,321,800 B1
(45) Date of Patent: Nov. 27, 2001

(54) POWDER FEEDING APPARATUS, POWDER FEEDING METHOD AND POWDER PRESSING APPARATUS

(75) Inventors: Atsushi Ogawa; Toshiaki Tamura, both of Osaka-fu (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/560,352

(22) Filed: Apr. 28, 2000

(30) Foreign Application Priority Data

Apr. 30, 1999 (JP) ..... 11-123569

(51) Int. Cl.[7] ..... B65B 1/04
(52) U.S. Cl. ..... 141/71; 141/9; 141/100
(58) Field of Search ..... 141/71–81, 1, 141/9, 100, 286; 222/236, 238, 410, 58, 77, 203

(56) References Cited

U.S. PATENT DOCUMENTS 3,938,562 * 2/1976 McGillvary et al. ..... 141/1
5,637,836 * 6/1997 Nakagawa et al. ..... 177/105
5,697,523 * 12/1997 Brandauer ..... 222/58

FOREIGN PATENT DOCUMENTS 59-32568 9/1984 (JP) .
61-147802 7/1986 (JP) .
5-214404 8/1993 (JP) .

* cited by examiner

*Primary Examiner*—Steven O. Douglas
(74) *Attorney, Agent, or Firm*—Armstrong, Westerman, Hattori, McLeland & Naughton, LLP

(57) ABSTRACT

A powder pressing apparatus includes a powder feeding apparatus for supply of a powder such as a rare-earth alloy powder into a cavity of a tooling. The powder feeding apparatus includes a feeder box having a bottom face provided with an opening. Inside the feeder box, there are provided a hopper for supply of the powder into the cavity, a feeder for supply of the powder to the hopper, and a vibration generator for vibration of the hopper. Surfaces of the feeder and hopper to contact the powder are mirror-polished. Leg portions are provided in two sides of the bottom face parallel to a moving direction of the feeder box. The leg portions make the bottom face of the feeder box spaced from an opening of the cavity. The powder supplied to the powder feeding apparatus is weighed by a weighing unit. The opening of the feeder box is provided with a linear member arranged in a grid pattern having a regular pitch. The linear member is rotationally shaken in a horizontal plane when the powder is fed into the cavity. The linear member is shaken in a stroke greater than the pitch at which the linear member is arranged.

21 Claims, 19 Drawing Sheets

(a)
(b)
(c)
(d)
(e)
(f)
40
14
10
16
44
42
50
60
F
29
28
26
22
12
24
61

Sintered Body Height Comparison (mm)

| | Height | |
|---|---|---|
| Feeding Method | Individual | Wiping-off |
| Average | 17.91 | 18.06 |
| Maximum | 18.00 | 18.24 |
| Minimum | 17.81 | 17.80 |
| Inconsistency R(MAX-MIN) | 0.19 | 0.45 |
| Inconsistency R/AVE | 1.05% | 2.48% |
| Deviation σ | 0.045 | 0.097 |

Individual Powder Feeding(Pulling-in Method with Rotational Shaking Started before Cavity Formation)

FIG. 14A

Target Compact Height: 8 mm

| | Present Embodiment (mm) | (Reference) Comparative Example 1 | Comparative Example 2 (mm) |
|---|---|---|---|
| | Individual Powder Feeding(with Rotational Shaking Started before Cavity Formation) | Individual Powder Feeding(with Rotational Shaking Started after Cavity Formation) | Individual Powder Feeding(without Rotational Shaking) |
| | Height | Height | Height |
| Average AVE | 6.93 | 7.28 | Unable to form |
| Inconsistency R | 0.12 | 1.25 | |
| Inconsistency R/AVE | 1.73 % | 17.17 % | |
| n | 12 Blocks | 1 Block | 1 Block |

FIG. 14B

Target Compact Height: 16 mm

| | Present Embodiment (mm) | (Reference) Comparative Example 1 | Comparative Example 2 (mm) |
|---|---|---|---|
| | Individual Powder Feeding(with Rotational Shaking Started before Cavity Formation) | Individual Powder Feeding(with Rotational Shaking Started after Cavity Formation) | Individual Powder Feeding(without Rotational Shaking) |
| | Height | Height | Height |
| Average AVE | 13.87 | 13.87 | 13.86 |
| Inconsistency R | 0.14 | 0.55 | 0.29 |
| Inconsistency R/AVE | 1.01 % | 3.97 % | 2.09 % |
| n | 10 Blocks | 1 Block | 1 Block |

Individual Powder Feeding(Pulling-in Method with Rotational Shaking started after Cavity Formation)

POWDER FEEDING APPARATUS, POWDER FEEDING METHOD AND POWDER PRESSING APPARATUS

BACKGROUND OF THE INVENTION

1. Field of the Invention

The present invention relates to a powder feeding apparatus, a powder feeding method and a powder pressing apparatus, and more specifically to a powder feeding apparatus and a powder feeding method used for feeding a powder into a cavity of a tooling when pressing the powder for manufacture of a rare-earth magnet, and a powder pressing apparatus comprising such a powder feeding apparatus.

2. Description of the Related Art

In manufacture of a rare-earth magnet for example, a raw material rare-earth alloy is first milled into a powder, then pressed into a compact, sintered, aged, surface-treated and so on before the final sintered magnet is produced. In the above process, uniformity and accuracy in the amount of feeding the powder in the pressing step has a significant meaning in coercive force, remanence and dimensional accuracy of the product. If there is substantial inconsistency in the amount of feeding, there results correspondingly large inconsistency in coercive force, remanence and dimensional accuracy. In an attempt to overcome the problem therefore, there has been a number of powder feeding apparatuses proposed.

For example, as a powder feeding apparatus of this kind, a powder feeding apparatus as shown in FIGS. 17~19 is proposed in the Japanese Patent Application No. 11-364889.

The powder feeding apparatus 1 shown in the above figures is used in manufacture of a rare-earth magnet. The powder feeding apparatus 1 includes a feeder box 3 having a bottom face formed with an opening 2 and movable above an opening of a cavity formed in a tooling. Inside the feeder box 3, there are provided a plurality of rod members 4 for horizontal movement at least at a bottom portion of the feeder box 3. The rod members 4 are moved by a cylinder mechanism 5. The parallel movement of the rod members 4 provides a pushing action, making possible to supply a predetermined volume of a powder 6 into the cavity of the tooling.

Another related art is disclosed in the Japanese Patent Laid-Open No. 61-147802.

According to this disclosure, a magnetic powder is put in a feeder cup having a bottom portion attached with a metal net. The feeder cup is vigorously vibrated by a solenoid, thereby sieving the magnetic powder by the metal net into a granular form when fed.

However, according to the powder feeding apparatus 1 disclosed in the Japanese Patent Application No. 11-364889, the parallel movement of the rod members 4 creates hollows and coagulated drifts in the powder 6, causing inconsistency in density of the powder 6 supplied in the cavity. Further, since the apparatus is to feed a predetermined volume, even if stable supply is achieved in the volume, there is sometimes difference in the weight of the feed, resulting in inconsistency in the weight of the compact.

Further, when the feeder box 3 is withdrawn from above the cavity, the bottom face of the feeder box 3 drags the powder 6 on top of the cavity. This also causes inconsistency in the amount of the powder supply, resulting especially in inconsistency in feeding density near the cavity top surface, sometimes leaving undulation in the surface.

Still further, since the powder 6 has a small grain diameter of 1 $\mu$m~5 $\mu$m, the powder 6 is unavoidably left on the die. Especially, when a magnetic field is applied, the powder 6 left on the die gathers around the cavity, but the powder 6 scattered on the die has already been oxidized by contact with air. This oxidized powder 6 is wiped into the cavity by a front face of the feeder box 3 when the feeder box 3 is moved onto the cavity. When sintered, the oxidized powder 6 increases oxygen inclusion in the magnet, deteriorating magnetic properties.

Further, if the pressing is performed without sufficient amount of the powder 6 supplied, a resulting compact becomes more apt to crack, or density difference in the compact results in dimensional inconsistency after the sintering. This is especially problematic when forming a thin compact. The related art disclosed in the Japanese Patent Laid-Open No. 61-147802 also uses the wiping technique for the feeding. Thus, even with the provision of the metal net, there are the same problems as described above.

SUMMARY OF THE INVENTION

It is therefore a primary object of the present invention to provide a powder feeding apparatus, a powder feeding method and a powder pressing apparatus capable of eliminating the feeding inconsistency of the powder in the cavity.

According to an aspect of the present invention, there is provided a powder feeding apparatus including a feeder box movable above an opening of a cavity of a tooling and having a bottom face provided with an opening. The powder feeding apparatus comprises a hopper provided in the feeder box, for supply of a desired weight of powder to the cavity; a feeder for supply of the powder to the hopper when the feeder box is positioned above the opening of the cavity; and a spacing means for spacing at least the bottom face of the feeder box to face the opening of the cavity, from the opening of the cavity.

According to another aspect of the present invention, there is provided a powder feeding method using a feeder box movable above an opening of a cavity of a tooling and having a bottom face provided with an opening. The method comprises: a first step of supplying the feeder box with a desired weight of powder; a second step of moving the feeder box to above the opening of the cavity, with at least a bottom face of the feeder box to face the opening of the cavity being spaced from an upper surface of the tooling; and a third step of supplying the powder from the feeder box to the cavity.

According to the present invention, when the feeder box is positioned above the opening of the cavity, the desired weight of the powder held by the feeder is supplied to the hopper. Therefore, the desired weight of the powder is supplied into the cavity. Further, at least the bottom face of the feeder box to face the opening of the cavity is spaced from a surface of the tooling when moved to above the opening of the cavity. Above the opening of the cavity, the bottom face of the feeder box is spaced from the opening of the cavity. Therefore, the problems caused by the sliding of the feeder box on the tooling can be eliminated, making possible to feed the powder uniformly into the cavity.

Preferably, the spacing means includes leg portions provided in two side portions of the bottom face parallel to a moving direction of the feeder box, and the leg portions are slid on the tooling. This makes the bottom face of the feeder box spaced easily from the cavity opening.

Further, preferably, the feeder and the hopper have mirror-polished surfaces for contact with the powder respectively.

More preferably, the hopper is vibrated when feeding. This makes possible to supply an entire amount of a desired weight of the powder thoroughly and reliably from the feeder through the hopper and then to the cavity.

If the die is formed with a plurality of cavities for obtaining the plurality of compacts in a single pressing operation, and if the powder is supplied to each of the cavities by the wiping-off method, there is a problem that the powder to be supplied to one cavity can be dragged by the bottom face of the feeder box into another cavity. However, if the feeder box is provided with the plurality of hoppers and if each of the hoppers is provided with the feeder, it becomes possible to supply each of the cavities with the desired weight of the powder. Further, since the opening of the cavity and the bottom face of the feeder box is spaced from each other, there is no problem as described above.

According to another aspect of the present invention, there is provided a powder pressing apparatus comprising a tooling in which a cavity is formed, a powder feeding apparatus for supply of a desired weight of powder to the cavity, and a weighing unit for weighing of the powder for supply to the powder feeding apparatus. The powder feeding apparatus includes: a feeder box movable above an opening of the cavity and having a bottom face provided with an opening; a hopper provided in the feeder box, for supply of the powder to the cavity; a feeder for supply of the powder to the hopper when the feeder box is positioned above the opening of the cavity; and a spacing means for spacing at least the bottom face of the feeder box to face the opening of the cavity, from the opening of the cavity.

According to the present invention, the weighed powder is supplied to the powder feeding apparatus, and this amount of the powder is fed to the cavity. Therefore, the cavity can be supplied with the desired weight of powder.

Preferably, the apparatus further comprises an orienting means for orientation of the powder in the cavity, and the weighing unit is spaced from the orienting means. By disposing the weighing unit away from the orienting means as described above, it becomes possible that the powder in the weighing unit is not magnetized even if the magnetic field for orientation is applied to the powder in the cavity, thereby preventing the powder from becoming less flowable due to the magnetization. Therefore, it becomes possible to feed the powder uniformly.

According to another aspect of the present invention, there is provided a powder feeding apparatus including a feeder box movable above an opening of a cavity formed in a tooling and having a bottom face provided with an opening, the feeder box containing a powder. The apparatus comprises a linear member disposed in the opening of the feeder box, and a shaking means for horizontal shaking of the linear member when feeding the powder to the cavity.

According to another aspect of the present invention, there is provided a powder feeding method using a feeder box movable above an opening of a cavity of a tooling and having a bottom face provided with an opening, the feeder box containing a powder. The opening of the feeder box is provided with a linear member, and the powder is supplied to the cavity while the linear member is horizontally shaken above the cavity.

According to the present invention, by horizontally shaking the linear member at the time of feeding, the powder is fed into the cavity without becoming a lump. Therefore, weight inconsistency of the powder and inconsistency in the feeding density become smaller in the cavity, yielding a compact of a higher quality.

Preferably, the linear member is arranged in a grid pattern. In this case, the linear member can contact a greater amount of the powder, making possible to feed the powder more uniformly.

Further, preferably, the grid pattern of the linear member has a regular pitch pattern, and a shaking stroke of the linear member is greater than the pitch of the linear member. In this case, the linear member can contact further more amount of the powder, and therefore the cavity can be fed with the powder even more uniformly.

Preferably, the linear member is shaken in a circular or an oval motion. Such a motion of the linear member can be achieved by a simple constitution, and therefore the powder can be fed easily and uniformly.

If a plurality of cavities are fed with the powder in a single operation, possibility for the feeding inconsistency increases. However, if the feeder box is formed with the plurality of openings and each of the openings is disposed with the linear member, then it becomes possible to reduce the feeding inconsistency in each of the cavities.

Further, since the powder can be uniformly fed into the cavity according to the present invention, a greater effect is obtained if a rare-earth alloy powder which has a poor flowability is used as the powder.

The above objects, other objects, characteristics, aspects and advantages of the present invention will become clearer from the following description of embodiments to be presented with reference to the accompanying drawings.

BRIEF DESCRIPTION OF THE DRAWINGS

FIG. 14A and FIG. 14B are tables showing a result of experiment;

DETAILED DESCRIPTION OF THE PREFERRED EMBODIMENTS

Embodiments of the present invention will be described here below with reference to the attached drawings.

Figure 1:
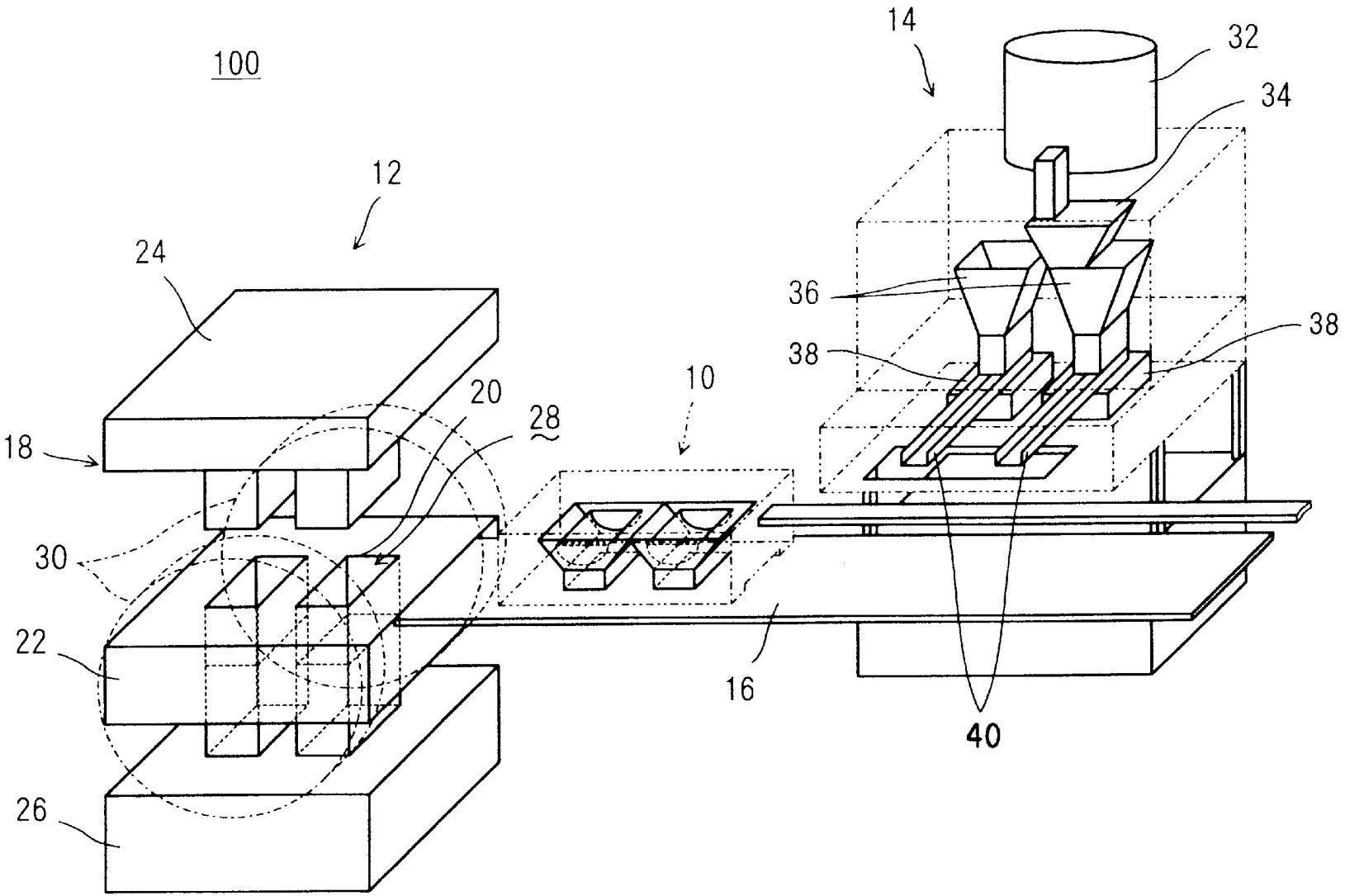
FIG. 1 is a perspective view showing an overall constitution of a powder pressing apparatus as an embodiment of the present invention.

Referring now to FIG. 1, a powder pressing apparatus 100 incorporating a powder feeding apparatuslo as an embodiment of the present invention will be described.

The powder pressing apparatus 100 is used for obtaining a rare-earth magnet for example, and comprises the powder feeding apparatus 10, pressing portion 12, weighing unit 14, and a carrying table 16 disposed for reciprocating movement by the powder feeding apparatus 10 between the pressing portion 12 and the weighing unit 14.

The pressing portion 12 includes a tooling 18. The tooling 18 includes a die 22 having a plurality (specifically two, according to the present embodiment) of through holes 20 each formed vertically, an upper punch 24 and a lower punch 26 to be inserted into the through holes 20 from above and below respectively. Cavities 28 are formed in the respective through holes 20. By inserting the upper punch 24 and the lower punch 26 into the through holes 20, a powder F is pressed into a predetermined form in the cavities 28. On two sides of the die 22, there is disposed a pair of pole pieces (not illustrated) and coils 30 wound around respective pole pieces, for application of magnetic field to orient the powder F in the cavities 28.

The weighing unit 14 is disposed away from the pole pieces and the coils 30 so that the powder F in the weighing unit 14 is not magnetized before being fed into the cavity 28. The weighing unit 14 includes a rotating feeder 32. A predetermined amount of the powder F is supplied from the rotating feeders 32 via laterally movable chutes 34 to two respective hoppers 36. Below each of the hoppers 36, there is disposed a straight feeder 40 provided with a subtracting weighing capacity scale 38 manufactured by Mu INSTRUMENTS TRADING CORP. The straight feeder 40 conveys the powder F toward its tip by vibration, supplying the powder F to the powder feeding apparatus 10. The weighing capacity scales 38 weigh decrease in the weight of the powder F caused by the supply of predetermined amount of the powder F from the straight feeder 40 to the powder feeding apparatus 10, thereby allowing control on the amount of supply of the powder F to the powder feeding apparatus 10.

There is no specific limitation to the powder F. The powder F may be a hard-to-handle powder having a poor flowability and high reactivity: A good example is a rare-earth alloy powder used in forming a rare-earth magnet such as R—Fe—B permanent magnet represented by a Nd—Fe—B permanent magnet, and R—Fe—N permanent magnet represented by an Sm—Fe—N permanent magnet.

Figure 2:
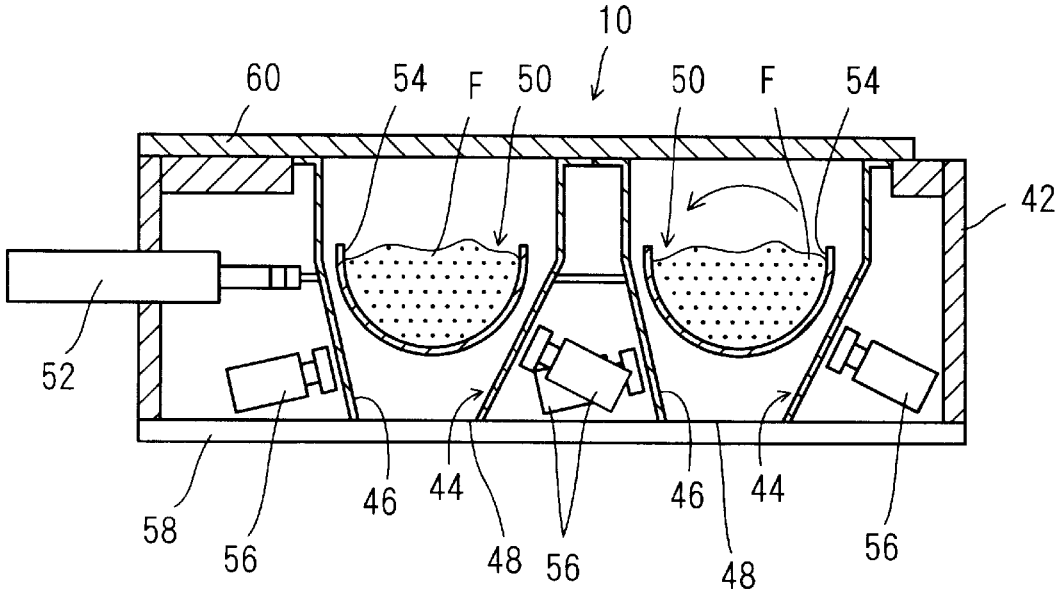
FIG. 2 is a sectional front view showing a powder feeding apparatus.
Figure 3:
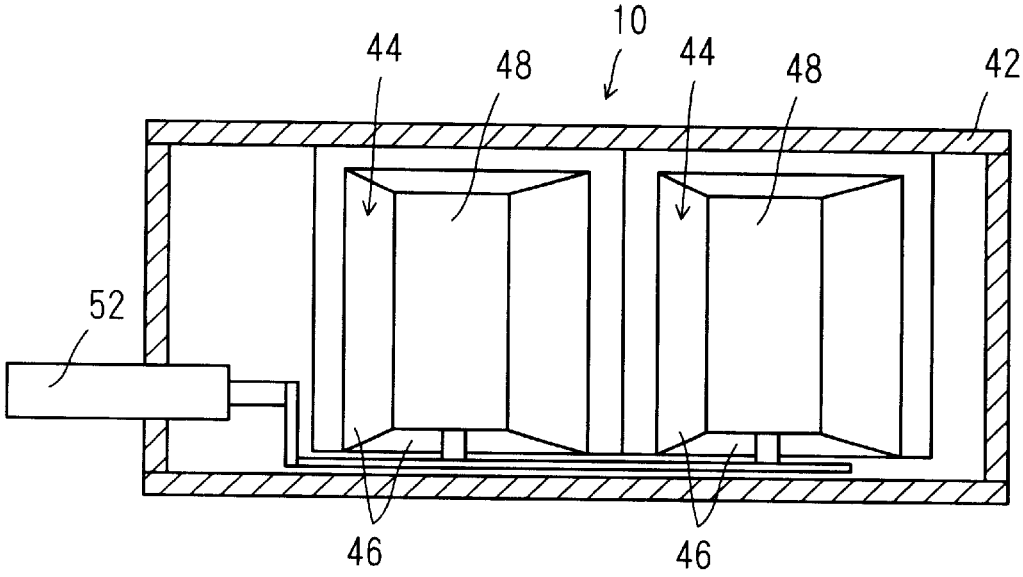
FIG. 3 is a sectional plan view of the same, with a feeder removed.
Figure 4:
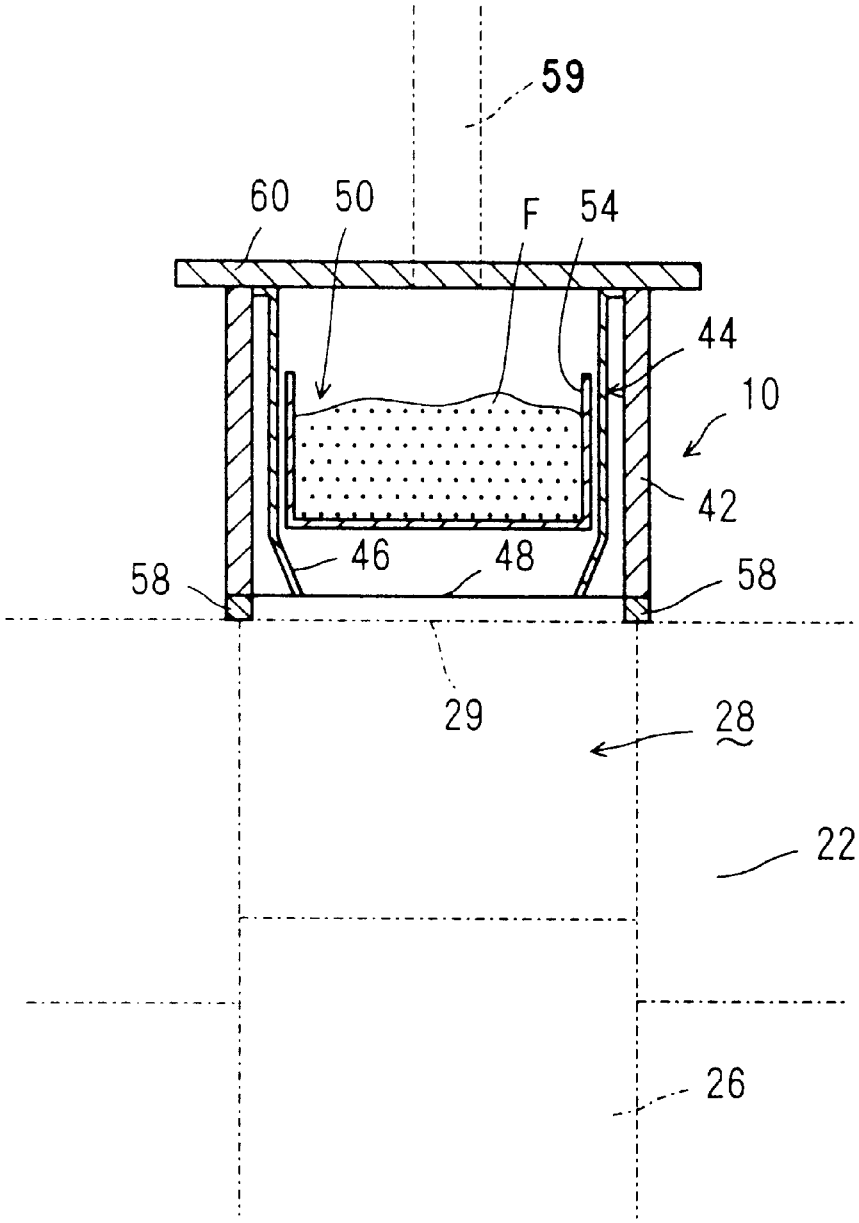
FIG. 4 is a sectional side view of the same, when disposed above a cavity.

The powder feeding apparatus 10 uses an individual feeding method in which each of the cavities 28 is fed with an individually weighed amount of the powder F, and as shown in FIG. 2 through FIG. 4, includes a feeder box 42. The feeder box 42 is made of stainless steel and is formed into a cuboid having a top face and a bottom face each formed with an opening for example. Two hoppers 44 are provided inside the feeder box 42. Each of the hoppers 44 has inner wall surface 46 forming a rectangular cross section. The inner wall surface 46 makes the upper opening generally as wide as the feeder box 42, whereas the inner wall surface 46 has inwardly slanted lower portions. Thus, the inner wall surface 46 make a lower edge portion having a rectangular opening 48 which is smaller than the upperopening. Each of the hoppers 44 is provided therein with a feeder 50, which is like a cylinder half made by cutting a cylinder along a longitudinal axis. The feeder 50 is rotatable via a rotating mechanism (not illustrated) operated by a cylinder 52. Therefore, the powder F supplied from the feeder 50 is guided by the hopper 44 and introduced toward the opening 48.

Each of the inner wall surface 46 of the hoppers 44 and the inner surface 54 of the feeders 50 is a surface to contact the powder F, and is mirror-polished by buffing for example. Further, vibration generators 56 each including a vibrator for example are disposed to contact outer side walls of the hoppers 44 so that the side walls of the hoppers 44 can be vibrated. Therefore, it is possible to supply a given amount of the powder F thoroughly from the feeders 50 through the hoppers 44 to the cavities 28 of the die 22.

Further, the bottom face of the feeder box 42 includes side portions parallel to a moving direction of the feeder box 42 each provided with a leg portion 58. By sliding the leg portions 58 on the carrying table 16 and the die 22, the bottom face of the feeder box 42 can be moved while being spaced from the upper surface of the die 22. Therefore, the bottom face of the feeder box 42 is spaced from the opening 29 of the cavity 28 when positioned above the opening 29 of the cavity 28 (see FIG. 4).

It should be noted here that an upper opening of the feeder box 42 is closed by a lid 60, except when the feeder box 42 is filled with the powder F, so that inside of the feeder box 42 can be insulated from air by an inert gas. The inert gas such as $N_2$ is supplied continuously through a pipe 59.

Figure 5:
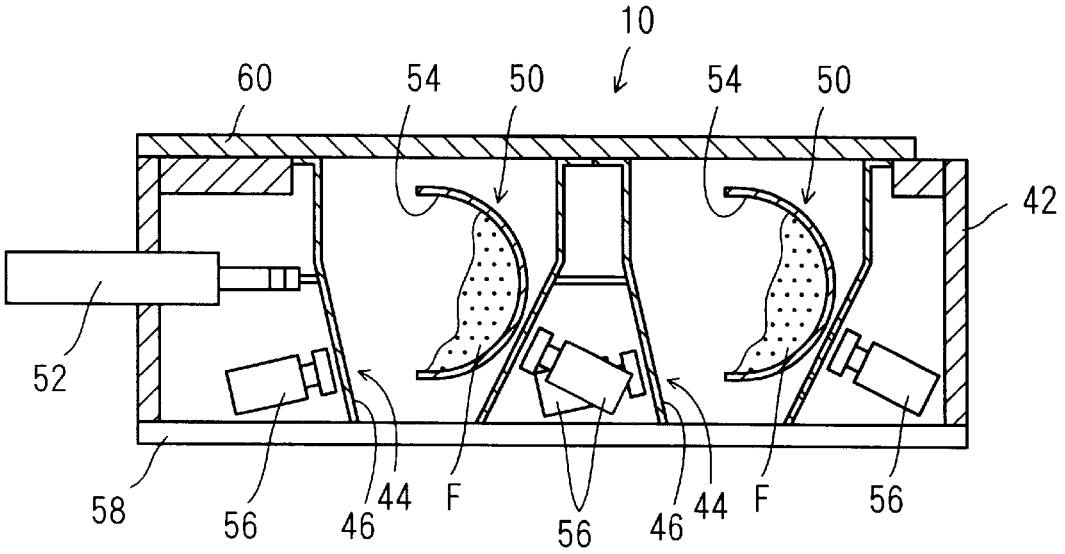
FIG. 5 is a sectional front view of the same, with the feeder rotated.

According to the powder feeding apparatus 10 as described above, when feeding the powder, each of the feeders 50 in the hoppers 44 is rotated by 90 degrees by a cylinder 52, making the opening of the feeder 50 vertical as shown in FIG. 5, thereby allowing the powder F to fall from an edge of the opening of the feeder 50 into the cavity 28. At this time, even if the powder F contacts the inner wall surface 46 of the hopper 44, the powder F can be reliably supplied into the cavity 28 without sticking, by operating the vibration generators 56.

Now, operation of the powder pressing apparatus 100 described as above will be described with reference to FIG. 6.

First, with the lid 60 of the feeder box 42 of the powder feeding apparatus 10 open, the powder feeding apparatus 10 is moved on the carrying table 16, bridging the feeder 50 in the hopper 44 below the straight feeder 40 of the weighing unit 14, with the opening of the feeder 50 facing upward. Next, a predetermined amount of powder F is supplied from the straight feeder 40 to the feeder 50 in the hopper 44 (FIG. 6(*a*)).

Then, the lid 60 of the feeder box 42 is closed, and an inert gas is introduced inside the feeder box 42 from an inert gas supplying apparatus (not illustrated). Under this state, the powder feeding apparatus 10 is moved on the carrying table 16 to the pressing portion 12 (FIG. 6(*b*)), and the opening 48 at the lower end portion of the hopper 44 of the powder feeding apparatus 10 is positioned above the opening 29 of the cavity 28 of the pressing portion 12.

Figure 6:
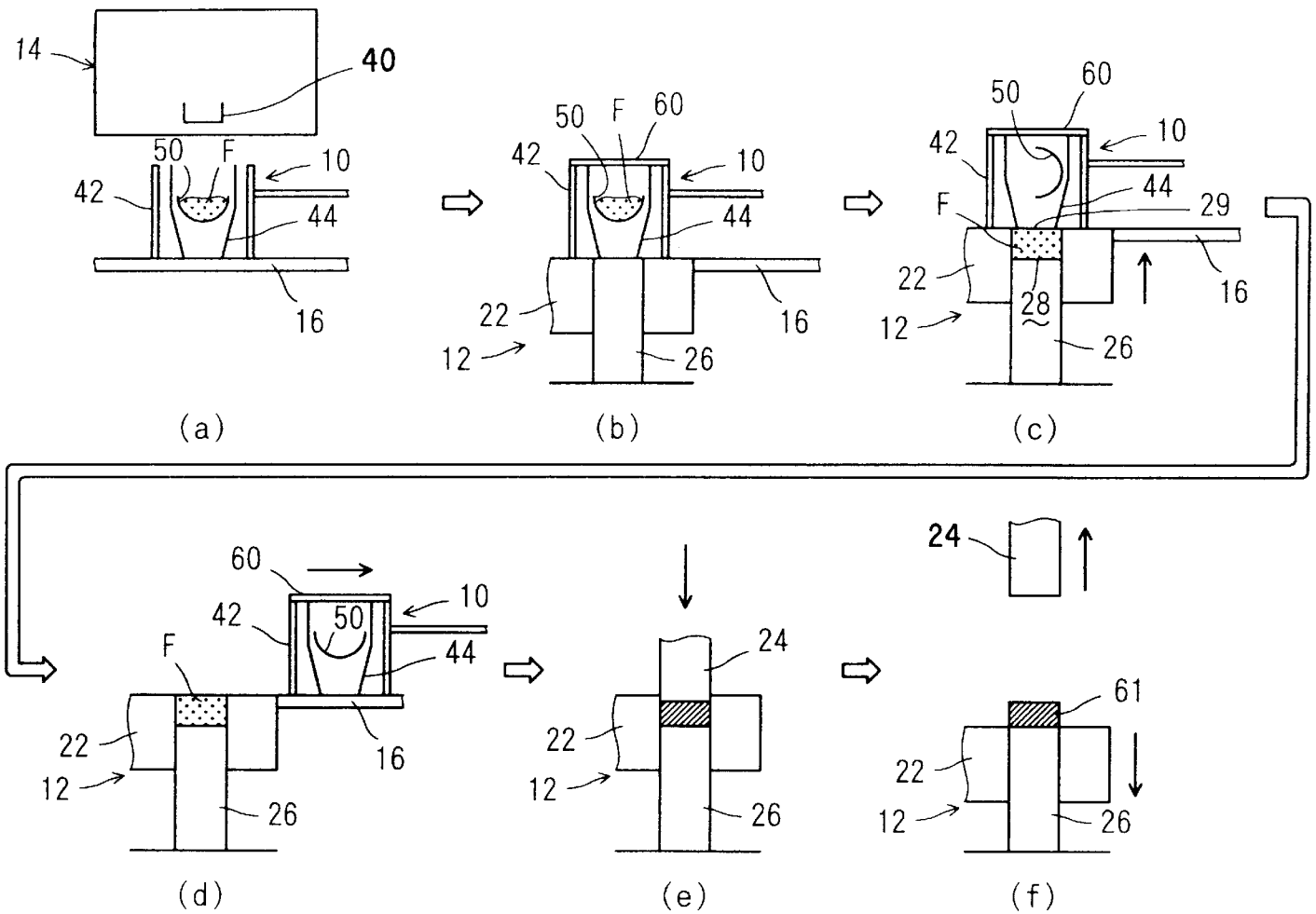
FIG. 6 is a schematic diagram showing an operation as an example, of the powder pressing apparatus in FIG. 1.

Then, by raising the die 22, the cavity 28 is formed, and by rotating the feeder 50, the powder F is fed into the cavity 28 (FIG. 6(*c*)). Thereafter, the powder feeding apparatus 10 is moved away (FIG. 6(*d*)), the powder F in the cavity 28 is oriented by the magnetic field, and pressed by the upper and lower punches 24, 26 (FIG. 6(*e*)). Then, the upper punch 24 is raised while the die 22 is lowered, and a compact 61 is taken out (FIG. 6(*f*)).

According to the powder feeding apparatus 10 of the powder pressing apparatus 100 as described above, only the leg portions 58 provided in the feeder box 42 contact the upper surfaces of the carrying table 16 and the die 22 during the operation. Thus, the bottom face of the feeder box 42 is easily and always spaced from the opening 29 of the cavity 28 of the dies 22.

Further, according to the powder pressing apparatus 100, an accurately weighed amount of the powder F can be supplied exactly by that weight. Thus, a desired weight of the powder F can be fed into the cavity 28.

Especially, even if the powder F has a low flowability such as a rare-earth alloy powder used in manufacturing a rare-earth magnet, it becomes possible to supply an accurately weighed amount of the powder F into the cavity 28.

Further, by providing a plurality of the hoppers 44 in the feeder box 42, and by providing each of the hoppers 44 with the feeder 50, it becomes possible to supply a desired weight of the powder F to each of the plurality of cavities 28.

Next, description will be made for an experiment.

The experiment was made by using the powder feeding apparatus 10 according to the present invention and a comparative example. The comparative example used a powder feeding apparatus, in which a shutter is opened near the cavity of the die and then the hopper is moved to above the opening of the cavity so that a weighed amount of the powder is supplied from the hopper into the cavity.

As the powder F, a raw material powder for an Nd—Fe—B magnet was used, with a target weight of 341 g to be supplied into a 200 $cm^3$ cavity having a sectorial opening. The powder F fed in the cavity was pressed into a compact for radii form, and then sintered for three hours at 1060° C. The sintered body obtained was weighed by an electronic weighing scale. The weighing was made for a total of fifty samples, and weight inconsistency was found as shown in FIG. 7 and FIG. 8.

Figure 7:
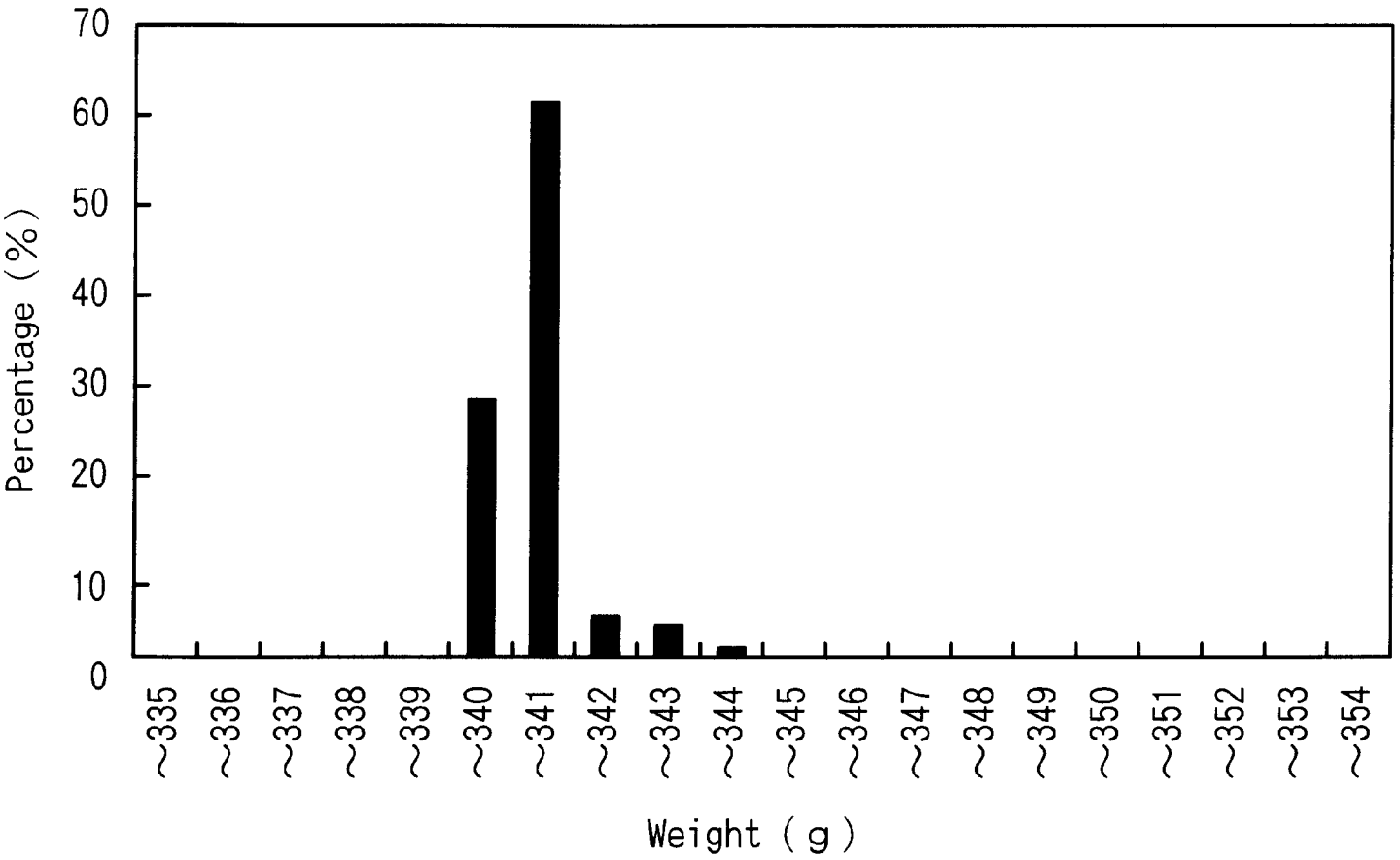
FIG. 7 is a characteristic graph showing powder feeding accuracy when the powder feeding apparatus in FIG. 2 was used.
Figure 8:
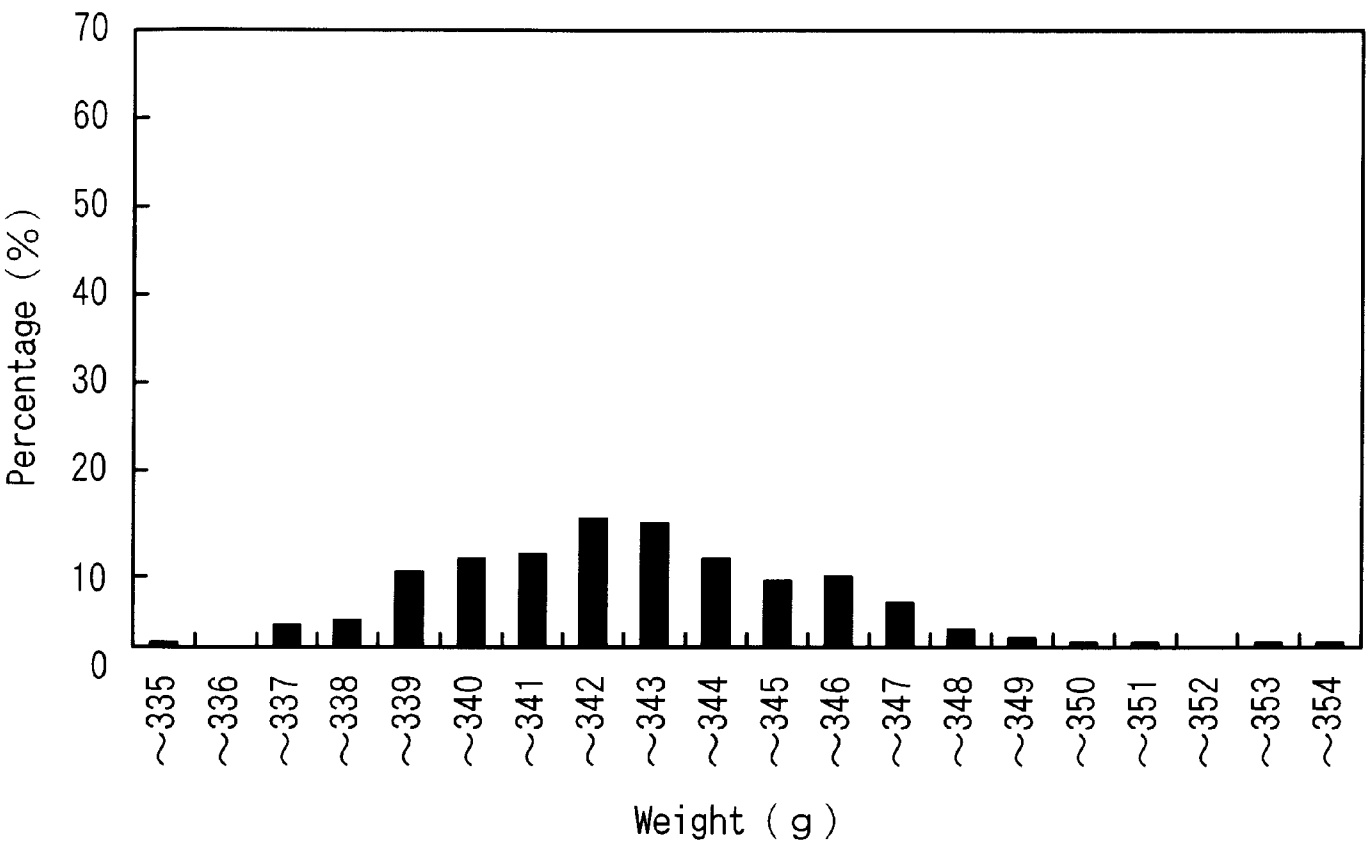
FIG. 8 is a characteristic graph showing the powder feeding accuracy when a comparative powder feeding apparatus was used.

In the case in which the powder feeding apparatus 10 was used, as shown in FIG. 7, the weight distribution showed concentration at the target weight of 341 g. In addition, the inconsistency was limited within a small range from 340 g to 344 g. On the contrary, in the case of the comparative example, as shown in FIG. 8, a mean of the weight distribution is off the target value of 341 g, and in addition, the inconsistency range was wider, being from 335 g to 354 g. Therefore, if the powder feeding apparatus 10 is used, the weight inconsistency of the sintered body can be reduced.

Figures 9A, 9B:
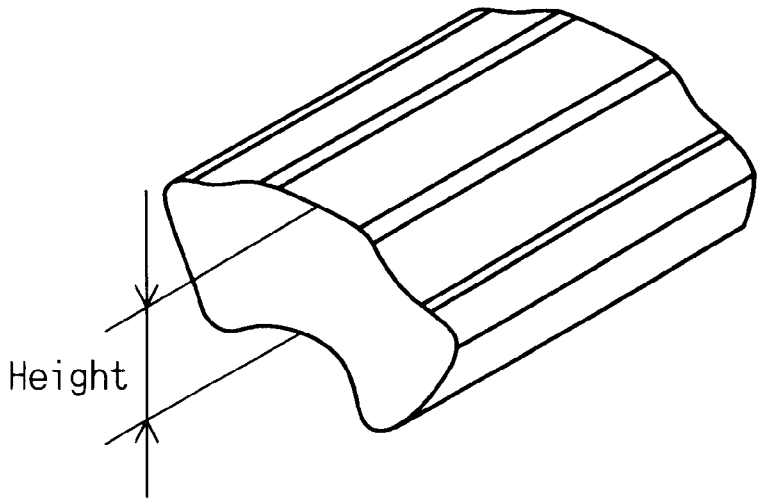
FIG. 9A is a table showing comparison of a height of a sintered body.
FIG. 9B is a schematic diagram for describing the height of the sintered body.

Next, another experiment was conducted, in which the individual feeding was made by using the powder feeding apparatus 10 in one case, and the wiping-off feeding was made in another case, and height of the obtained sintered bodies were compared as summarized in FIG. 9A. The term "height" as used herein refers to a thickness, or a dimension from an upper surface to the lower surface of the sintered body as shown in FIG. 9B. The height was measured at one point for each of the fifty sintered body obtained. The inconsistency R (MAX−MIN) refers to a difference between a maximum measurement and a minimum measurement in the height of the fifty sintered bodies.

In the case of the individual feeding by the powder feeding apparatus 10, because of the small weight inconsistency, as understood from FIG. 9A, the inconsistency R (MAX−MIN) of the sintered body height can be smaller. Therefore, it becomes possible to manufacture a magnet member having small dimensional errors and high magnetic properties.

Figure 10:
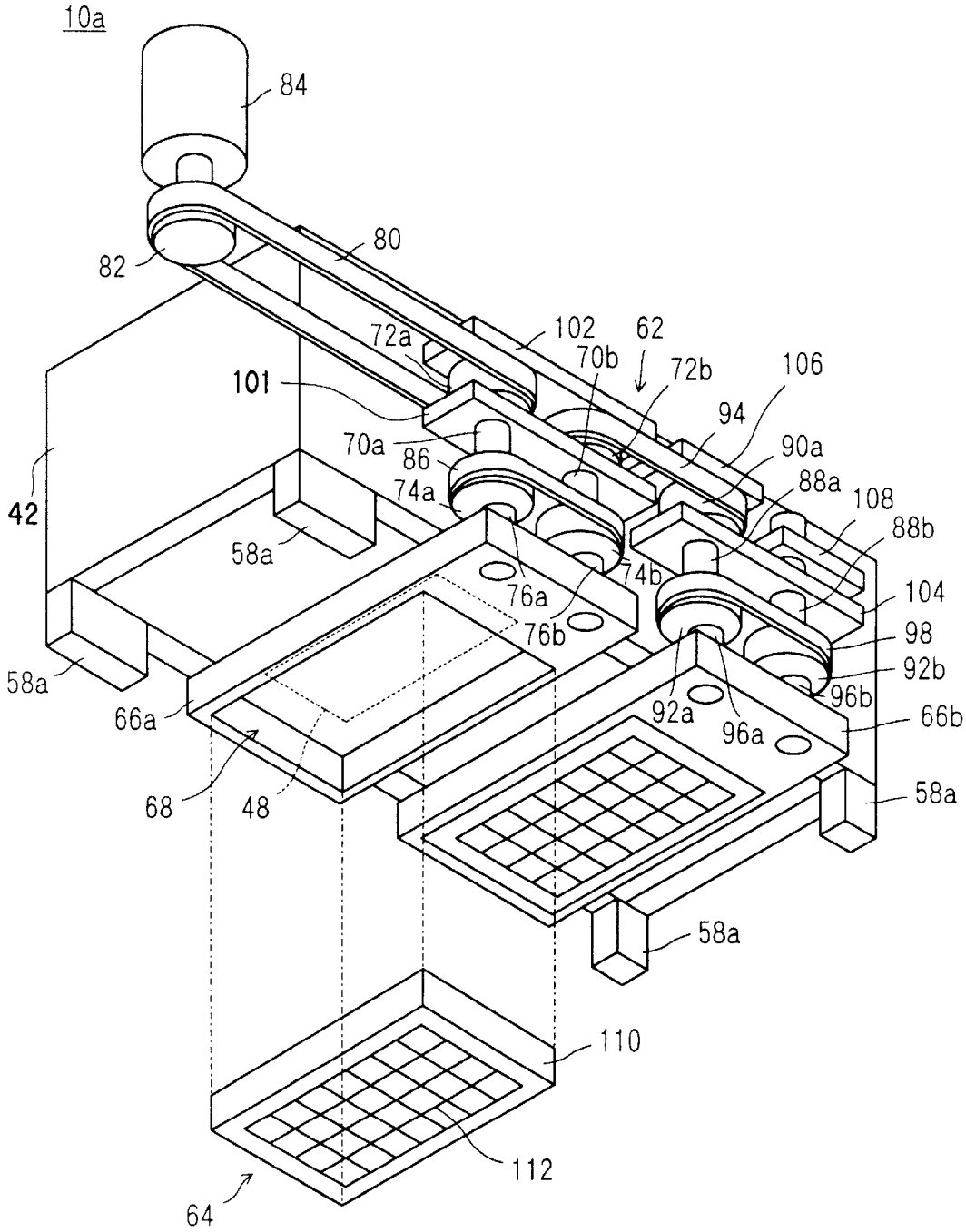
FIG. 10 is a perspective view showing another powder feeding apparatus.

Alternatively, another powder feeding apparatus 10*a* as shown in FIG. 10 may be used.

The powder feeding apparatus bOa is exactly the same as the powder feeding apparatus 10 shown in FIGS. 2~5, differing only in that leg portions 58*a* are used as the leg portions, and that the feeder box 42 is provided with a shaking means 62 and leveling members 64 shaken by the shaking means 62.

The shaking means 62 includes a plurality (specifically two, according to the present embodiment) of holders 66*a*, 66*b* disposed in the bottom face of the feeder box 42 respectively. The holders 66*a*, 66*b* are disposed correspondingly to respective openings 48 of the hoppers 44 in the feeder box 42, and has through holes 68 to which the leveling members 64 are fitted respectively.

The shaking means 62 further includes rotating shafts 70*a*, 70*b*. The rotating shaft 70*a* has two ends provided with pulleys 72*a*, 74*a* respectively. The pulley 74*a* has a lower face attached with an eccentric rotating shaft 76*a*. The rotating shaft 76*a* is linked rotatably to a widthwise end of the holder 66*a*. The pulley 72*a* is connected to an electric motor 84 via a belt 80 and a pulley 82. The rotating shaft 70*b* has two ends provided with pulleys 72*b*, 74*b* respectively. The pulley 74*b* has a lower face attached with an eccentric rotating shaft 76*b*. The rotating shaft 76*b* is linked rotatably to a widthwise end of the holder 66*a*. The pulleys 74*a*, 74*b* are connected to each other ia a belt 86.

Further, the shaking means 62 includes rotating shafts 88*a*, 88*b*. The rotating shaft 88*a* has two ends provided with pulleys 90*a*, 92*a* respectively. The pulleys 90*a* and 72*b* are connected to each other by a belt 94. The pulley 92*a* has a lower face provided with an eccentric rotating shaft 96*a*. The rotating shaft 96*a* is linked rotatably to a widthwise end of the holder 66*b*. The rotating shaft 88*b* has a lower end provided with the pulley 92*b*. The pulley 92*b* has a lower face provided with an eccentric rotating shaft 96*b*. The rotating shaft 96*b* is linked rotatably to a widthwise end of the holder 66*b*. The pulleys 92*a* and 92*b* are connected to each other by a belt 98. Further, plate members 101~108 are attached to a side face of the feeder box 42. The rotating shafts 70*a*, 70*b* are rotatably inserted through and thereby positioned to the plate members 101 and 102. The rotating shaft 88*a* is rotatably inserted through and thereby positioned to the plate members 104 and 106. The rotating shaft 88*b* is rotatably inserted through and thereby positioned to the plate members 104 and 108. Each of the pulleys 74*a*, 74*b*, 92*a*, 92*b* is formed in a shape like a disc, for example.

Figure 11:
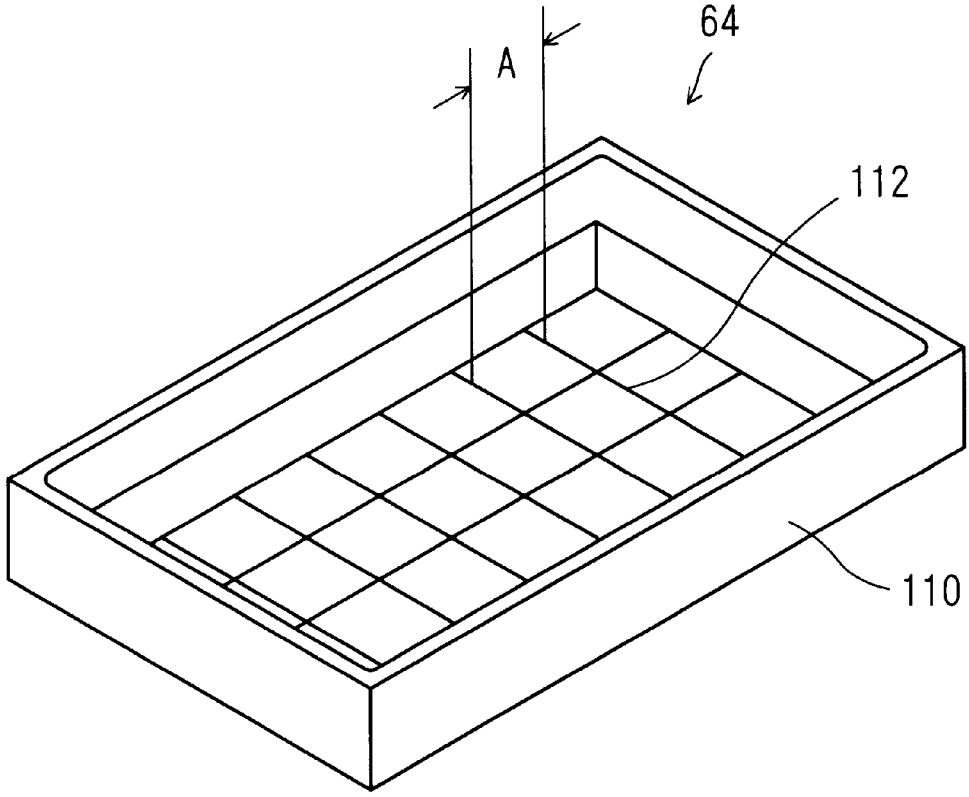
FIG. 11 is a perspective view showing a leveling member.

As shown also in FIG. 11, each of the leveling members 64 includes a rectangular frame 110, and the frame 110 has a lower face provided with a linear member 112 having a regular grid pattern. For example, the linear member 112 has a diameter of 0.4 mm and is arranged in the grid pattern at a pitch A, i.e. an interval, of 15 mm.

By fitting the leveling members 64 to the through holes 68 of the holders 66*a*, 66*b*, the linear members 112 are disposed in the bottom face of the feeder box 42.

It should be noted here that the frame 110 is preferably made of a stainless steel for its low reactivity with the fed powder F, superb resistance to abrasion, and ease of machining.

Further, preferably, the linear member 112 is rotationally shaken in a rotation diameter B (i.e. a shaking stroke: see FIG. 12) greater than the pitch A. By arranging the linear member 112 in the grid pattern and by making the shaking stroke greater than the pitch A, the linear member 112 can be contacted with a greater amount of the powder F, making possible to feed the powder F into the cavity 28 more uniformly.

Figure 12:
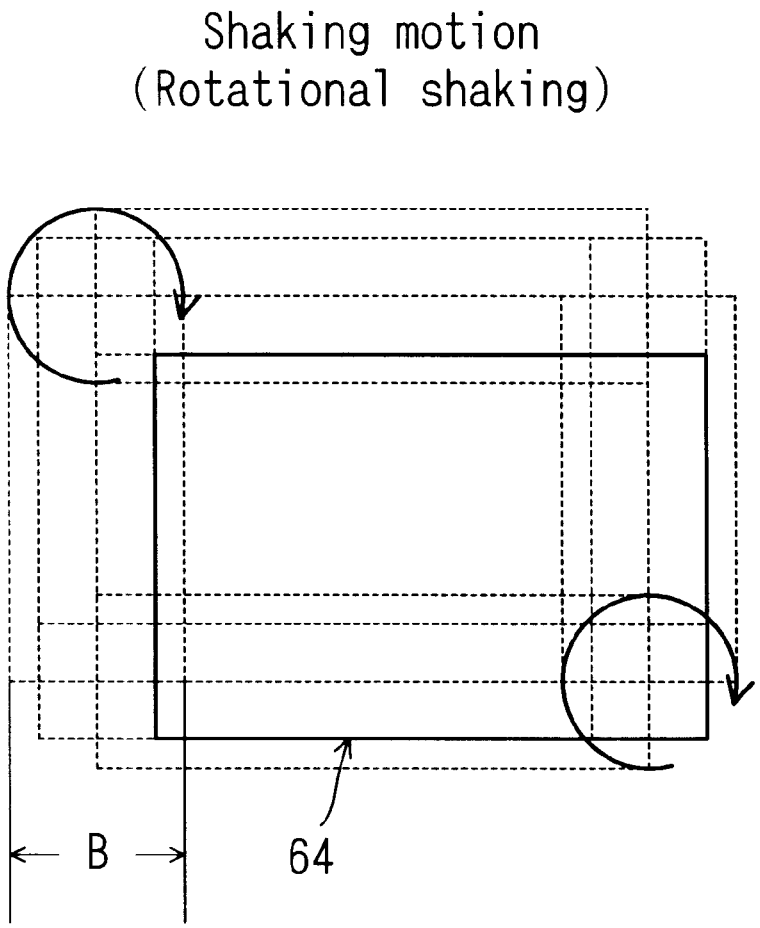
FIG. 12 is a schematic diagram illustrating a shaking action by a rotational shaking method.

According to the powder feeding apparatus 10*a* as described above, when the electric motor 84 of the shaking means 62 is driven to rotate the pulleys 74*a*, 74*b*, the eccentric shafts 76*a*, 76*b* are rotated, turning and shaking the leveling member 64 fitted to the holder 66*a*. At this time, the pulleys 92*a*, 92*b* are also rotated to rotate the eccentric shafts 96*a*, 96*b*, turning and shaking the leveling member 64 fitted to the holder 66*b*. Each portion of the leveling member 64 is rotationally shaken in a circular path as shown in FIG. 12.

According to the powder pressing apparatus 100 using the powder feeding apparatus 10*a*, by rotationally shaking the linear member 112 in a horizontal plane above the cavity 28, lumps of the powder F can be broken. Therefore, it becomes possible to reduce the weight inconsistency and the inconsistency in the feeding density of the powder F in the cavity 28. As a result, when the obtained compact is sintered, an individual magnet member having a small dimensional inconsistency and high magnetic properties can be manufactured.

Further, the present invention is especially effective in the individual feeding method, in which the feeding density of the powder F in the cavity 28 tends to be inconsistent.

Further, by forming the pulleys 74*a*, 74*b*, 92*a*, 92*b* in the disc-like shape, the motion path of rotational shaking can easily be made circular, making possible to feed the powder F easily and uniformly. It should be noted that if the pulleys 74*a*, 74*b*, 92*a*, 92*b* are shaped like oval discs, the motion path of rotational shaking can easily be made oval, making possible again in this case to feed the powder F easily and uniformly.

Further, rotating speed of the leveling member 64 is preferably 50 rpm~200 rpm. Within this range, the feeding can be efficient and the feeding density can be more uniform. If the rotating speed is slower than 50 rpm, it becomes difficult to level the powder F flatly. If the speed exceeds 200 rpm, increase in centrifugal force makes difficult the supply of the powder F into the cavity 28.

Still further, if a plurality of cavities 28 are formed in the die 22 and all the cavities 28 are fed with the powder F in a single operation, inconsistency in the feeding density tends to be greater than in single-piece forming (in which only one cavity is formed in the die). However, by forming the plurality of openings 48 in the feeder box 42 correspondingly to the cavities 28, and by providing each of the openings 48 with the leveling member 64, i.e. the linear member 112, it becomes possible to reduce the inconsistency in feeding density, making the effect of the present invention more remarkable.

It should also be noted here that the same effect as obtained by using the powder feeding apparatus 10 can be obtained by using the powder feeding apparatus 10*a*.

Next, description will cover experiment conducted by using the powder feeding apparatus 10*a* shown in FIG. 10.

The experiment used an Re—Fe—B alloy powder as the powder F. The compact density targeted was 4.3 g/cm$^3$, with compact dimensions of 80 mm×52 mm×height (h) mm. Two settings were made for the weight of the compact: 140 g for the height h=8 mm, and 280 g for the height h=16 mm.

In the experiment, the individual feeding (accompanied by the rotational shaking started before the cavity formation) was made by using the powder feeding apparatus 10*a* according to the present embodiment, whereas the individual feeding (accompanied by the rotational shaking started after the cavity formation) was made as the comparative example 1, and the individual feeding without the rotational shaking was made as the comparative example 2.

Before covering a result of the experiment, main steps of operation according to the present embodiment will be described with reference to FIG. 13.

Figure 13:
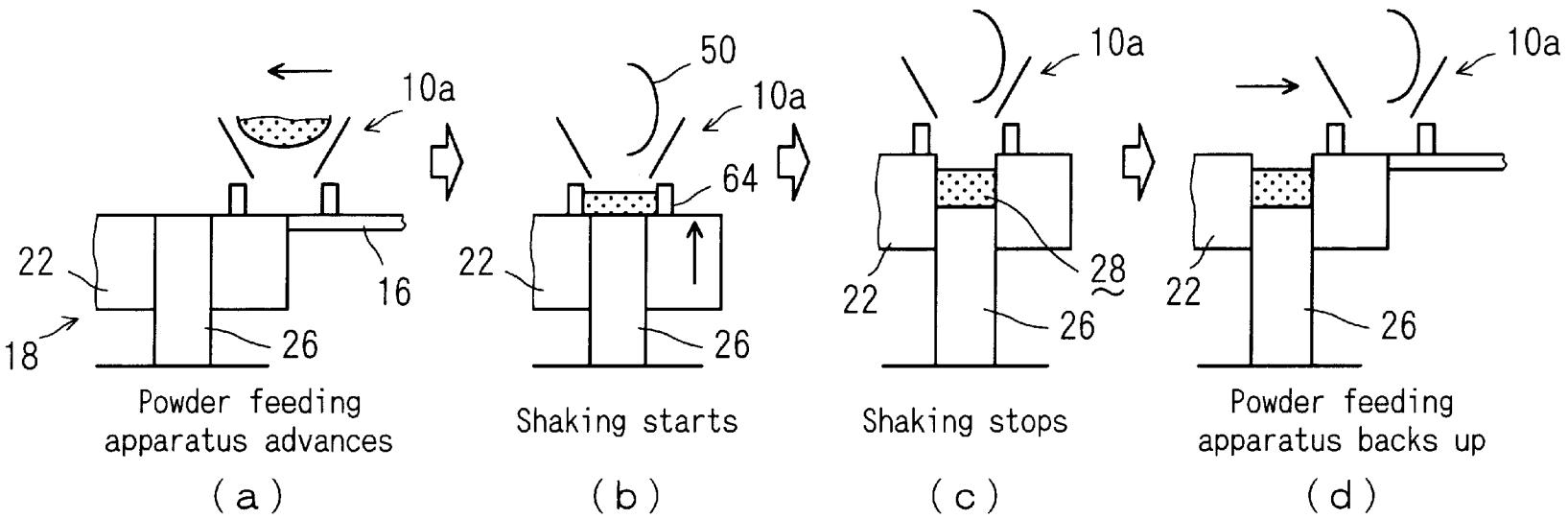
FIG. 13 is a schematic diagram showing a operation as an example when individual powder feeding (accompanied by the rotational shaking started before cavity formation) is made by using the powder feeding apparatus shown in FIG. 10.

First, the powder feeding apparatus 10*a* is moved to above the tooling 18 in which the cavity 28 is not yet formed (FIG. 13(*a*)). Then, the powder F is fed from the feeder 50 to the leveling member 64, and the rotational shaking operation of the powder feeding apparatus 10*a* is started (FIG. 13(*b*)). The die 22 is then raised to form the cavity 28, allowing the powder F to be fed into the cavity 28. When the cavity 28 is supplied with the entire amount of the powder F, the rotational shaking operation is stopped (FIG. 13(*c*)), and the powder feeding apparatus 10*a* is moved away (FIG. 13(*d*)).

After the powder feeding steps were performed for each of the present embodiment and the two comparative examples, the feed was pressed into a compact,sintered, aged and manufactured into a magnet. For each of the magnets thus manufactured, an average height AVE, and inconsistency R were obtained as summarized in FIG. 14A and FIG. 14B.

Figure 15:
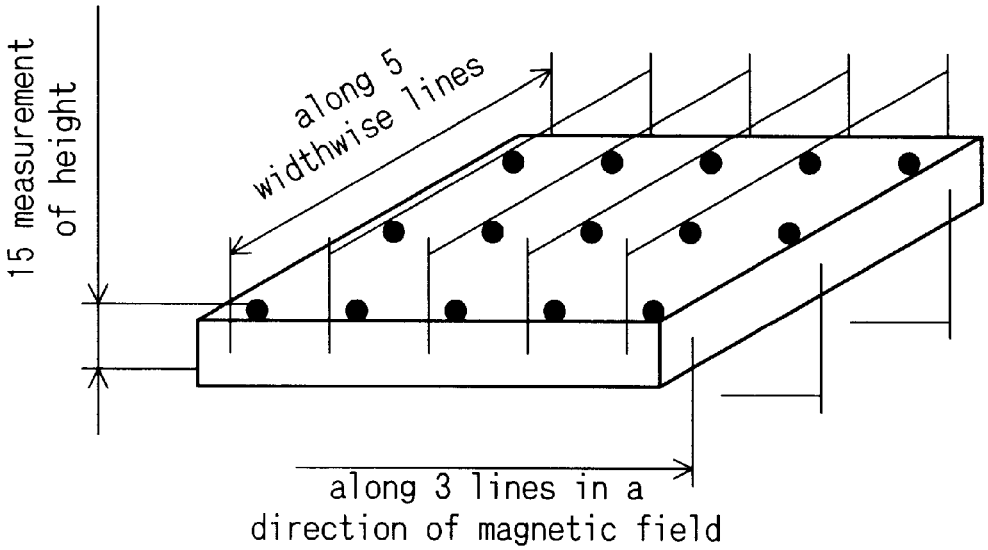
FIG. 15 is an illustration for describing inconsistency R.

Now, with reference to FIG. 15, the inconsistency R was obtained in the following manner. Specifically, for each of the obtained magnet, height was measured at fifteen locations (at intersections made by three lines in a direction of magnetic field with five widthwise lines), and a difference between a maximum value and a minimum value was obtained. The above operation was performed for each of n compacts and an average of the differences was obtained as the inconsistency R.

From FIG. 14A and FIG. 14B, it is learned that the inconsistency R of the magnet takes a lowest value for the present embodiment in both of the cases in which the target height of the compact was set to 8 mm, and 16 mm.

Further, when the target height of the compact was 16 mm, the inconsistency R in the comparative example 1 was "0.55", whereas the inconsistency R in the present embodiment was "0.14". On the other hand, when the target height of the compact was 8 mm, the inconsistency R in the comparative example 1 was "1.25", whereas the inconsistency R in the present embodiment was "0.12", showing a remarkably more significant improvement in the inconsistency R. As will be understood from these results, the present invention is more effective when obtaining the compact of a smaller thickness.

Figure 16:
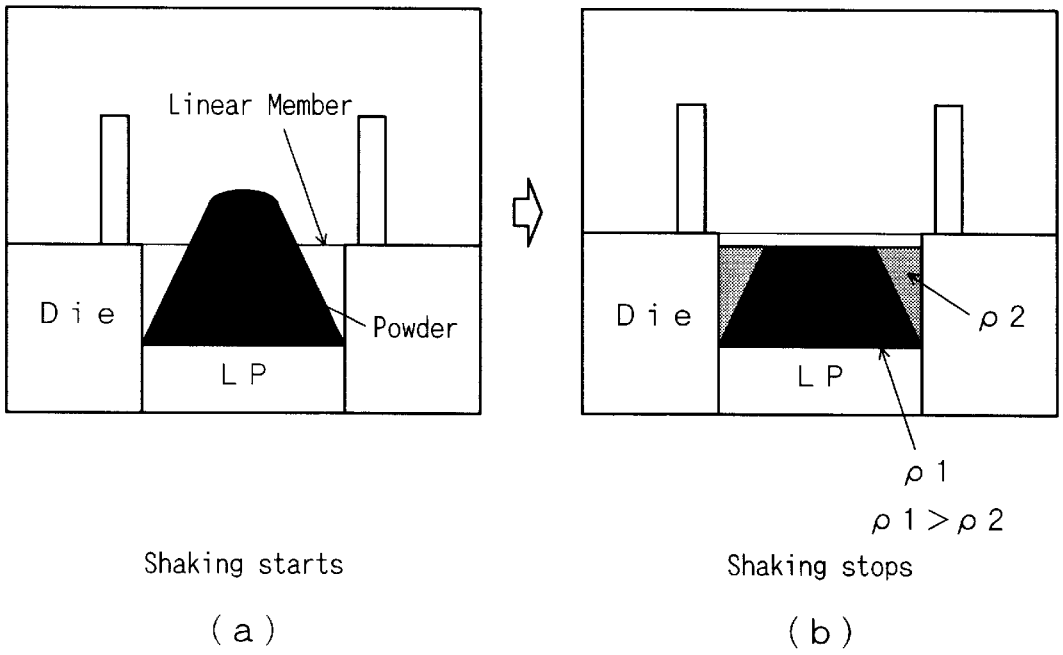
FIG. 16 is a schematic diagram showing a state of powder supply in an individual powder feeding (accompanied by the rotational shaking after the cavity formation).
Figure 17:
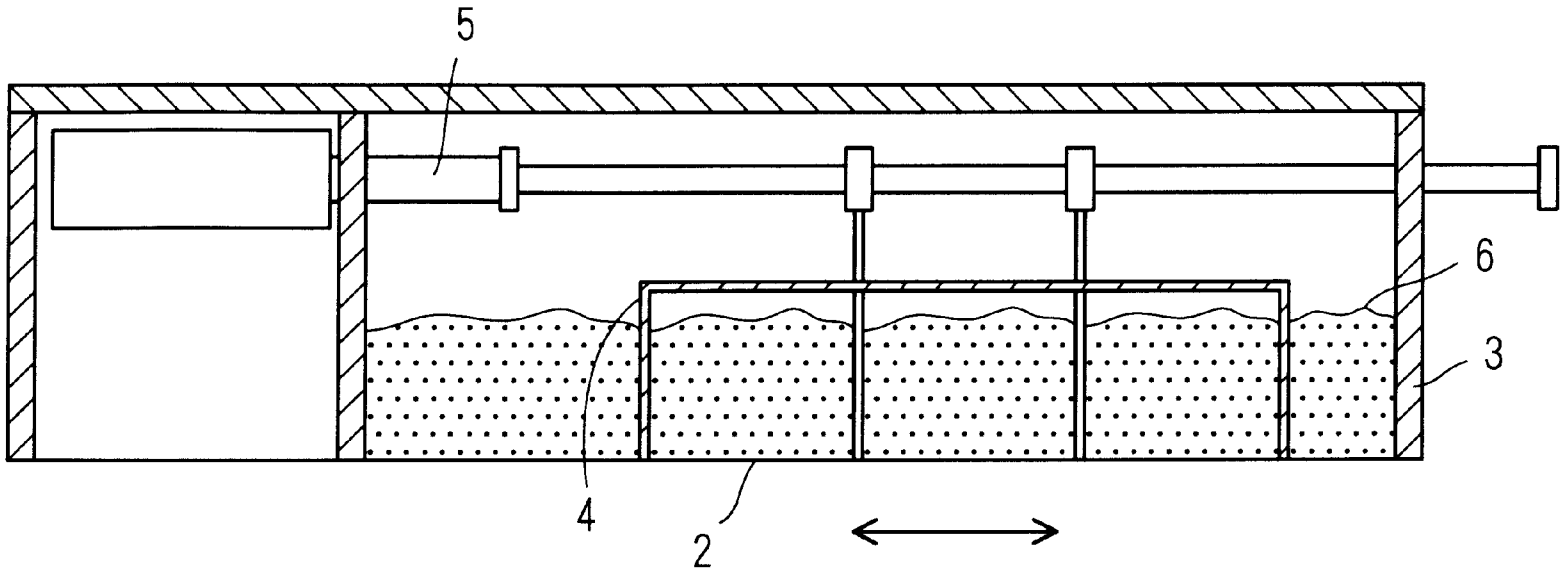
FIG. 17 is a sectional front view showing a powder feeding apparatus already disclosed.
Figure 18:
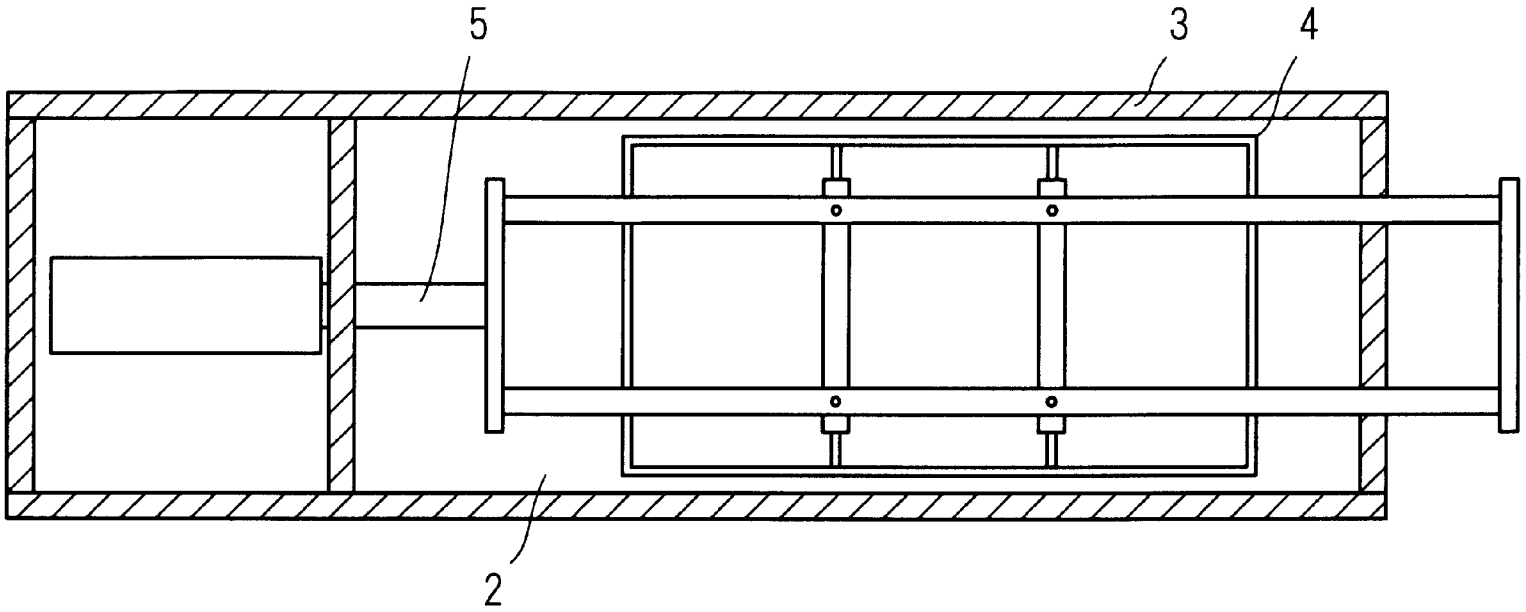
FIG. 18 is a sectional plan view showing the same.
Figure 19:
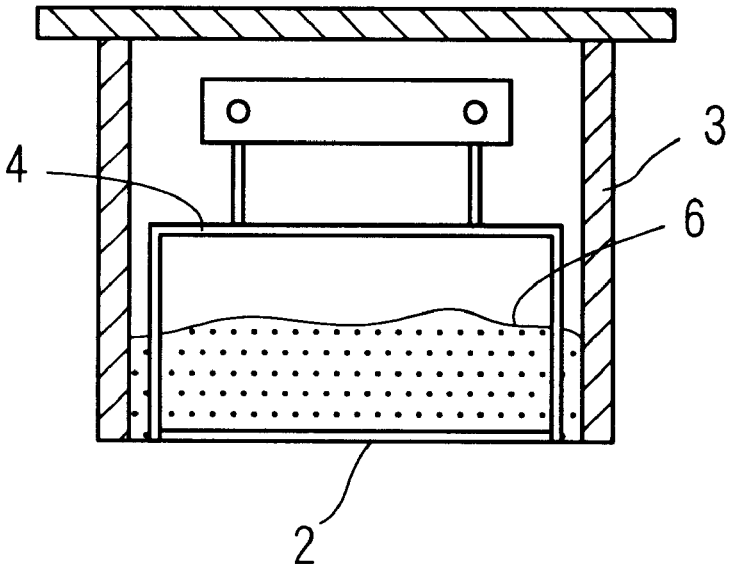
FIG. 19 is a sectional side view of the same.

For reference, according to the comparative example 1 in which the individual feeding (accompanied by the rotational shaking started after the cavity formation) was performed, first, the cavity was supplied with the powder, and then the rotational shaking was started (FIG. 16(*a*)), and the rotational shaking is stopped when the powder has been leveled (FIG. 16(*b*)). However, in this case, as will be understood from $\rho 1 > \rho 2$, the feeding density becomes greater in a center portion of the cavity. Therefore, as shown in FIG. 14, the inconsistency R becomes large.

It should be noted that according to the above embodiment, the feeder 50 which is like a cylinder half is used as the feeder. However, the feeder is not limited by this; for example, a plate-like or a bowl-like feeder, or feeders of any other shape can be used in accordance with the cavity 28 and the amount of supply of the powder F.

Further, the angle of rotation of the feeder 50 may be discretionary between the range from 90 degrees to 360 degrees.

Further, the shaking means 62 and the leveling member 64 shown in FIG. 10 can be applied to a powder feeding apparatus for feeding the powder F in which the wiping-off method is used in the feeding operation. The linear member 112 of the leveling member 64 may alternatively be arranged in a net pattern.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A powder feeding apparatus for supply of a powder to a cavity of a tooling, comprising:

a feeder box movable above an opening of the cavity and having a bottom face provided with an opening;

a hopper provided in the feeder box, for supply of a desired weight of powder to the cavity;

a feeder for supply of the powder to the hopper when the feeder box is positioned above the opening of the cavity; and a spacing means for spacing at least the bottom face of the feeder box to face the opening of the cavity, from the opening of the cavity.

2. The apparatus according to claim 1, wherein the spacing means includes leg portions for sliding on the tooling, provided in two side portions of the bottom face parallel to a moving direction of the feeder box.

3. The apparatus according to claim 1, wherein the feeder has a mirror-polished surface for contact with the powder.

4. The apparatus according to claim 1, wherein the hopper has a mirror-polished surface for contact with the powder.

5. The apparatus according to claim 1, further comprising a vibrating means for vibration of the hopper.

6. The apparatus according to claim 1, wherein a plurality of the hoppers are provided in the feeding box, each of the hoppers being provided with the feeder.

7. A powder pressing apparatus comprising:

a tooling in which a cavity is formed;

a powder feeding apparatus for supply of a desired weight of powder to the cavity; and a weighing unit for weighing of the powder for supply to the powder feeding apparatus;

the powder feeding apparatus including:

a feeder box movable above an opening of the cavity and having a bottom face provided with an opening;

a hopper provided in the feeder box, for supply of the powder to the cavity;

a feeder for supply of the powder to the hopper when the feeder box is positioned above the opening of the cavity; and a spacing means for spacing at least the bottom face of the feeder box to face the opening of the cavity, from the opening of the cavity.

8. The apparatus according to claim 7, further comprising an orienting means for orientation of the powder in the cavity, the weighing unit being spaced from the orienting means.

9. A powder feeding apparatus for supply of a powder to a cavity of a tooling, comprising:

a feeder box movable above an opening of the cavity and having a bottom face provided with an opening, the feeder box containing the powder;

a linear member disposed in the opening of the feeder box; and a shaking means for horizontal shaking of the linear member when feeding the powder to the cavity.

10. The apparatus according to claim 9, wherein the linear member is arranged in a grid pattern.

11. The apparatus according to claim 10, wherein the grid pattern of the linear member has a regular pitch pattern, a shaking stroke of the linear member being greater than the pitch of the linear member.

12. The apparatus according to claim 9, wherein the linear member is shaken in a circular or an oval motion.

13. The apparatus according to claim 9, wherein a plurality of the openings are formed in the feeder box, each of the openings being disposed with the linear member.

14. The apparatus according to claim 1 or 9, wherein the powder is a rare-earth alloy powder.

15. A powder feeding method using a feeder box movable above an opening of a cavity of a tooling and having a bottom face provided with an opening, the method comprising:

a first step of supplying the feeder box with a desired weight of powder;

a second step of moving the feeder box to above the opening of the cavity, with at least a bottom face of the feeder box to face the opening of the cavity being spaced from an upper surface of the tooling; and a third step of supplying the powder from the feeder box to the cavity.

16. The method according to claim 15, wherein the powder is supplied while the hopper is vibrated in the third step.

17. A powder feeding method using a feeder box movable above an opening of a cavity of a tooling and having a bottom face provided with an opening, the feeder box containing a powder, wherein the opening of the feeder box is provided with a linear member, the powder being supplied to the cavity while the linear member is horizontally shaken above the cavity.

18. The method according to claim 17, wherein the linear member is arranged in a grid pattern.

19. The method according to claim 18, wherein the grid pattern of the linear member has a regular pitch pattern, a shaking stroke of the linear member being greater than the pitch of the linear member.

20. The method according to claim 17, wherein the linear member is shaken in a circular or an oval motion.

21. The method according to claim 17, wherein a plurality of the openings are formed in the feeder box, and each of the openings being disposed with the linear member.

* * * * *

UNITED STATES PATENT AND TRADEMARK OFFICE

CERTIFICATE OF CORRECTION

PATENT NO. : 6,321,800 B1
DATED : November 27, 2001
INVENTOR(S) : Atsushi Ogawa et al.

It is certified that error appears in the above-identified patent and that said Letters Patent is hereby corrected as shown below:

Column 5,
Line 18, change “apparatuslo” to -- apparatus 10 --;

Column 8,
Line 15, change “apparatus bOa” to -- apparatus 10a --; and

Column 9,
Line 66, change “Re–Fe–B” to -- R-Fe-B --.

Signed and Sealed this

Fourth Day of June, 2002

*Attest:*

*Attesting Officer*

JAMES E. ROGAN
*Director of the United States Patent and Trademark Office*